US009671748B2

(12) United States Patent
Kobayashi et al.

(10) Patent No.: US 9,671,748 B2
(45) Date of Patent: Jun. 6, 2017

(54) IMAGE FORMING APPARATUS HAVING A DEVELOPING CARTRIDGE WITH MOUNTING INTERVAL REGULATION

(71) Applicant: CANON KABUSHIKI KAISHA, Tokyo (JP)

(72) Inventors: Takahiro Kobayashi, Nagareyama (JP); Hiromasa Katayama, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/996,376

(22) Filed: Jan. 15, 2016

(65) Prior Publication Data

US 2016/0216678 A1 Jul. 28, 2016

(30) Foreign Application Priority Data

Jan. 23, 2015 (JP) ..... 2015-011550

(51) Int. Cl.
*G03G 21/18* (2006.01)
*G03G 21/16* (2006.01)

(52) U.S. Cl.
CPC ..... *G03G 21/1821* (2013.01); *G03G 21/1671* (2013.01); *G03G 21/181* (2013.01); *G03G 21/185* (2013.01)

(58) Field of Classification Search
CPC .... G03G 15/75; G03G 15/751; G03G 15/757; G03G 21/181; G03G 21/185
USPC ..... 399/111–114, 262; 222/DIG. 1
See application file for complete search history.

(56) References Cited

U.S. PATENT DOCUMENTS 5,347,343 A * 9/1994 Ohtsuka ..... G03G 15/751 399/111
6,097,909 A * 8/2000 Watanabe ..... G03G 21/1853 399/111
6,324,370 B1 * 11/2001 Isobe ..... G03G 15/0875 222/DIG. 1
7,945,193 B2 * 5/2011 Kakitani ..... G03G 15/0813 399/111

(Continued)

FOREIGN PATENT DOCUMENTS

JP H02-035163 A 2/1990
JP H07-325530 A 12/1995

(Continued)

*Primary Examiner* — David M Gray
*Assistant Examiner* — Laura Roth
(74) *Attorney, Agent, or Firm* — Fitzpatrick, Cella, Harper & Scinto

(57) ABSTRACT

An image bearing member unit includes an image bearing member for bearing a toner image; a bearing portion which rotatably supports the image bearing member and is coaxial with a rotational axis of the image bearing member and which includes an arcuate portion for forming a circumferential part of a circle larger than the image bearing member; a holding portion, capable of permitting insertion of the bearing portion in a rotational axis direction of the image bearing member, for holding the bearing portion; and a passing portion, provided in the holding portion, for permitting passage of the arcuate portion therethrough in the rotational axis direction. The passing portion is provided so that a phase of the arcuate portion when the bearing portion is mounted at a normal position and a phase of the passing portion are different from each other.

8 Claims, 14 Drawing Sheets

(56) References Cited

U.S. PATENT DOCUMENTS

2009/0310993 A1* 12/2009 Tamaoki ..... G03G 15/065
399/46

FOREIGN PATENT DOCUMENTS

| | | | |
|---|---|---|---|
| JP | H08-320634 | A | 12/1996 |
| JP | 2002-268519 | A | 9/2002 |
| JP | 2010-271408 | A | 12/2010 |

* cited by examiner (a) CLOSED POSITION (b) OPEN POSITION (a) DURING INSERTION (b) FIXED STATE (a) DURING INSERTION (b) FIXED STATE

IMAGE FORMING APPARATUS HAVING A DEVELOPING CARTRIDGE WITH MOUNTING INTERVAL REGULATION

FIELD OF THE INVENTION AND RELATED ART

The present invention relates to an image bearing member unit mountable in an image forming apparatus, such as a printer, a copying machine or a facsimile machine, for forming a character image or a pictorial image using a toner, and relates to the image forming apparatus.

An image forming apparatus in which photosensitive drum units and developing units are alternately arranged along an intermediary transfer belt and are individually pullable in a rotational axis direction of an associated photosensitive drum from an apparatus main assembly has been widely used (Japanese Laid-open Patent Application (JP-A) 2010-271408).

In the photosensitive drum unit, a bearing portion for supporting a rotation shaft of the photosensitive drum is provided with an arcuate portion (regulating portion) projecting toward a rotation shaft of a developing sleeve of the developing unit, so that a mounting position of the developing unit is regulated by contact of the arcuate portion with a bearing of the developing sleeve in some cases. This is because the photosensitive drum and the developing sleeve are positioned in parallel to each other to form a gap between the photosensitive drum and the developing sleeve equally over a rotational axis direction.

In order to mount the bearing portion, an opening is provided at a holding portion of the photosensitive drum unit. In the case where the bearing portion includes the arcuate portion, at the opening, a passing portion which is recessed outwardly in a radial direction and which permits passage of the arcuate portion therethrough in the rotational axis direction is formed.

In the case where an angular position of the photosensitive drum about a rotational axis as seen from the rotational axis direction of the photosensitive drum is defined as a phase, when a position where the passing portion is provided is set in phase with a position where the arcuate portion is mounted, an inconvenience is generated in movement of the photosensitive drum unit. When the passing portion for permitting therethrough is provided in a casing of the photosensitive drum unit, the casing is extended to an outside of the arcuate portion, so that a part of the casing of the photosensitive drum unit projects toward the developing sleeve side (FIG. 11). For this reason, in order to prevent the casing from interfering with the developing sleeve when the photosensitive drum unit is pulled out in the rotational axis direction, a distance in which the developing sleeve and the photosensitive drum are spaced from each other is required to be increased, so that the increased distance leads to upsizing of the image forming apparatus.

Therefore, as disclosed in JP-A 2002-268519, a cut-away portion directed toward the developing sleeve was formed at an edge of an opening to obtain a U-shaped mounting portion, and a bearing portion was mounted at the U-shaped mounting portion.

As disclosed in JP-A 2002-268519, when the bearing portion is mounted at the U-shaped mounting portion which partly opens, compared with the case where the bearing portion is mounted at an opening of which circumference is closed, supporting rigidity of the photosensitive drum lowers, and thus vibration of the photosensitive drum during operation becomes problematic. For this reason, there is a need to ensure supporting strength and damping performance of the photosensitive drum by increasing a thickness of a casing of the photosensitive drum unit or by disposing a reinforcing rib on the casing of the photosensitive drum unit.

SUMMARY OF THE INVENTION

A principal object of the present invention is to provide an image bearing member unit pullable out in a rotational axis direction while avoiding an interference wish a developing unit.

According to an aspect of the present invention, there is provided an image bearing member unit comprising: an image bearing member for bearing a toner image; a bearing portion which rotatably supports the image bearing member and is coaxial with a rotational axis of the image bearing member and which includes an arcuate portion for forming a circumferential part or a circle large than the image bearing member; a holding portion, capable of permitting insertion of the bearing portion in a rotational axis direction of the image bearing member, for holding the bearing portion; and a passing portion, provided in the holding portion, for permitting passage of the arcuate portion therethrough in the rotational axis direction, wherein the passing portion is provided so that a phase of the arcuate portion when the bearing portion is mounted at a normal position and a phase of the passing portion are different from each other.

Further features of the present invention will become apparent from the following description of exemplary embodiments with reference to the attached drawings.

DESCRIPTION OF THE EMBODIMENTS

Embodiments of the present invention will be described in detail with reference to the drawings.

<Embodiment 1>

(Image Forming Apparatus)

Figure 1:
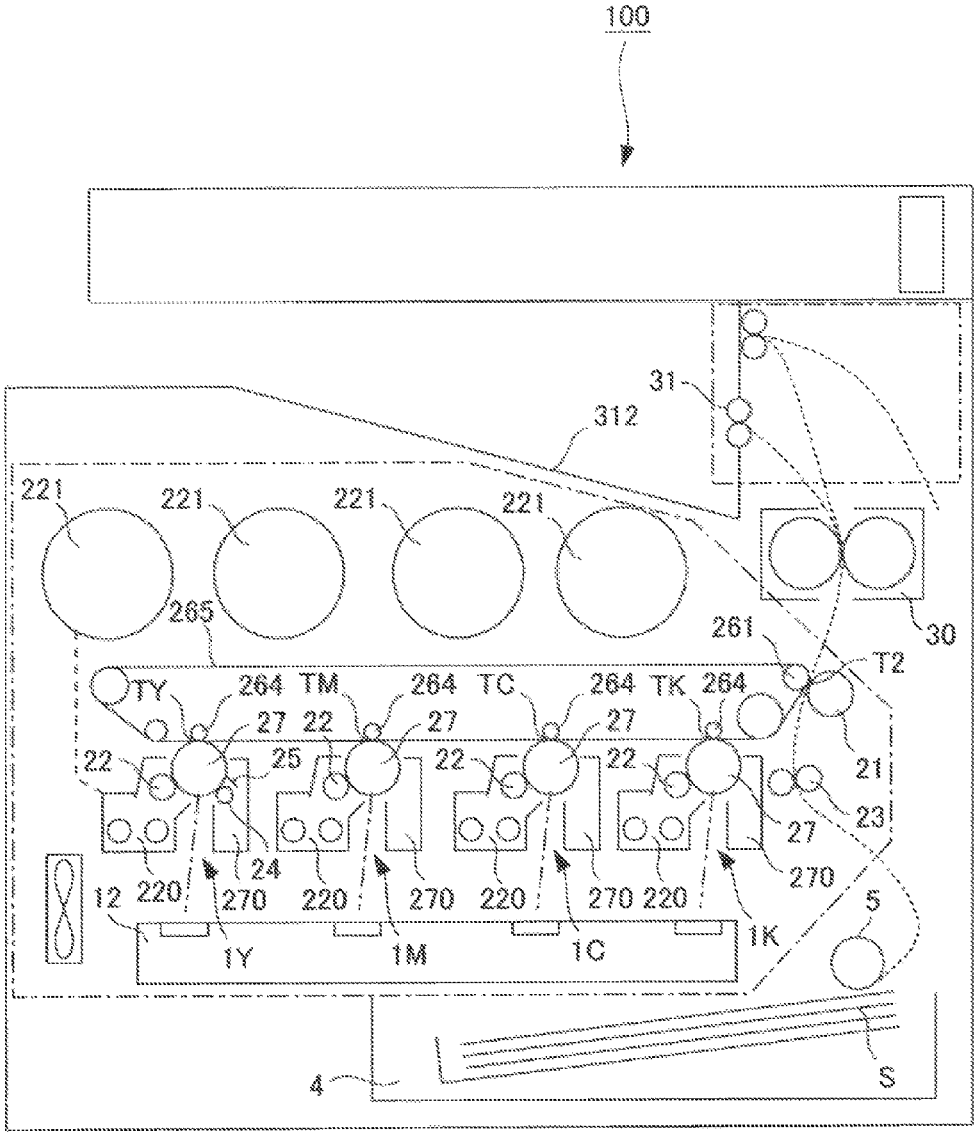
FIG. 1 is an illustration of a structure of an image forcing apparatus.

FIG. 1 is an illustration of a structure of an image forming apparatus 100. As shown in FIG. 1, the image forming apparatus 100 is an intermediary transfer type full color printer of a tandem type in which image forming portions 1Y, 1M, 1C and 1K are arranged along a downward surface of an intermediary transfer belt 265.

At the image forming portion 1Y, a yellow toner image is formed on a photosensitive drum 27(Y) and then is transferred onto the intermediary transfer belt 265. At the image forming portion 1M, a magenta toner image is formed on a photosensitive drum 27 and then is transferred onto the intermediary transfer belt 265. At the image forming portions 1C and 1K, cyan and black toner images ate formed on photosensitive drums 27(C) and 27(K) respectively, and then are transferred onto the intermediary transfer belt 265.

The four color toner images transferred on the intermediary transfer belt 265 are conveyed to a secondary transfer portion T2 and are secondary-transferred onto a recording material S. A separation roller 5 separates sheets of the recording material S, one by one, pulled out from a recording material cassette 4 and then feeds the recording material S to a registration roller pair 23. The registration roller pair 23 sends the recording material S to the secondary transfer portion T2 while being timed to the toner images on the intermediary transfer belt 265. The recording material S on which the four color toner images are secondary-transferred is pressed and heated by a fixing device 30, so that the toner images are fixed on a surface of the recording material S. Thereafter, the recording material S is discharged on a discharge tray 312 by a discharging roller pair 31. A toner cartridge 22 supplies a toner to a developing cartridge 220.

The image forming portions 1Y, 1M, 1C and 1K have the substantially same constitution except that colors of toners used in associated developing cartridges 220, respectively, are yellow, magenta, cyan and black, respectively, which are different from each other. In the following, the image forming portion 1Y is described, and redundant explanation about other image forming portions 1Y, 1M and 1C will be omitted.

The image forming portion 1Y includes, at a periphery of the photosensitive drum 27K, a charging roller 24, an exposure device 12, the developing cartridge 220, a transfer roller 264 and a cleaning blade 25. The photosensitive drum 27 rotates at a predetermined process speed. The charging roller 24 electrically charges a surface of the photosensitive drum 27 to a negative potential uniformly. The exposure device 12 scans the surface of the photosensitive drum 27 with a laser beam, obtained by ON-OFF modulation of a scanning line image signal developed from an associated color image, through a rotating mirror, so that an electrostatic image for an image is written (formed) on the surface of the photosensitive drum 1K. The developing cartridge 220 develops the electrostatic image into a toner image by transferring the toner onto the photosensitive drum 27. The transfer roller 264 transfers the toner image from the photosensitive drum 27 onto the intermediary transfer belt 265. The cleaning blade 25 removes a transfer residual toner by sliding on the photosensitive drum 27.

(Drum Cartridge)

Figure 2:
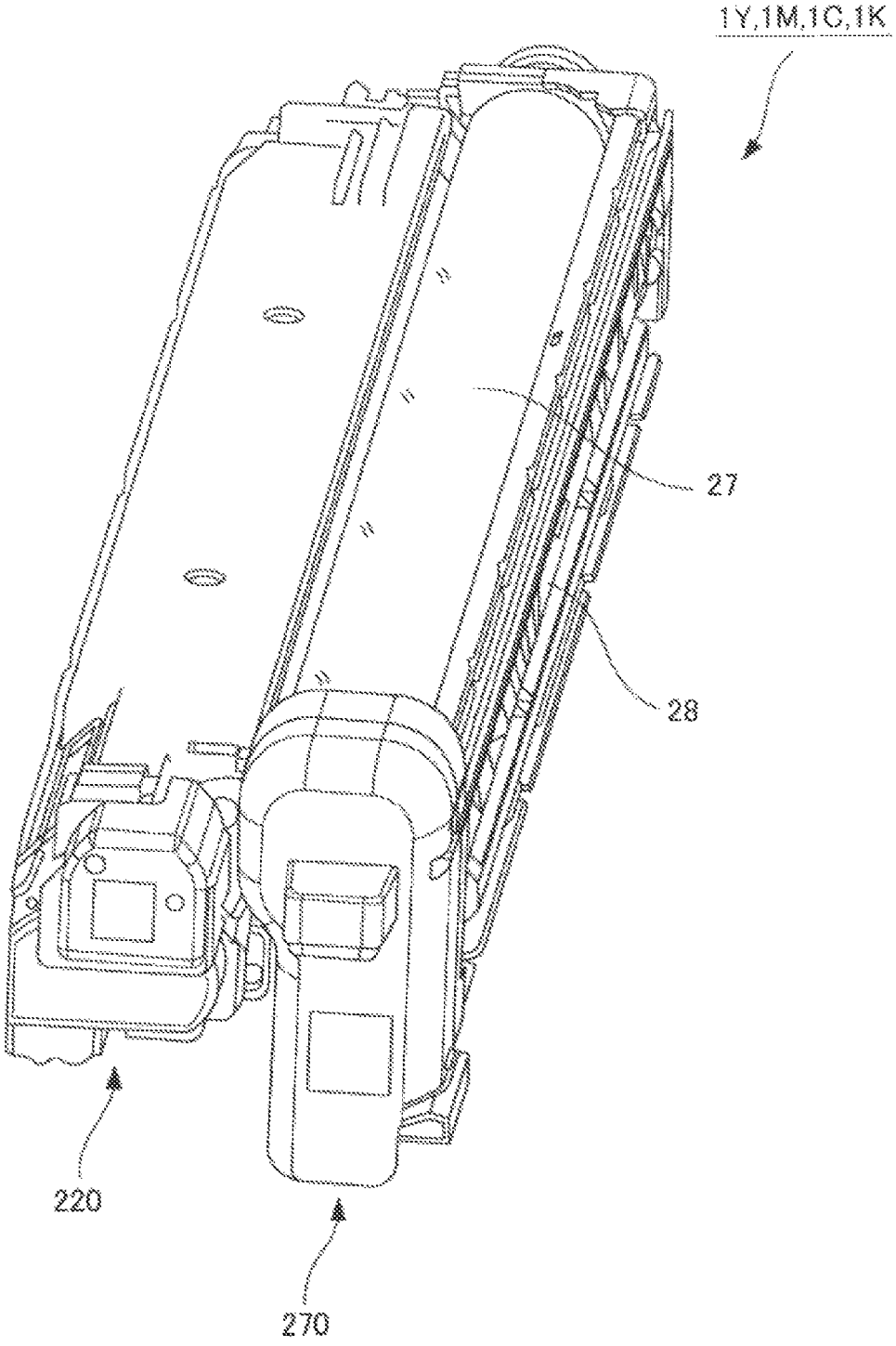
FIG. 2 is a perspective view of an outer appearance or an image forming portion.
Figure 3:
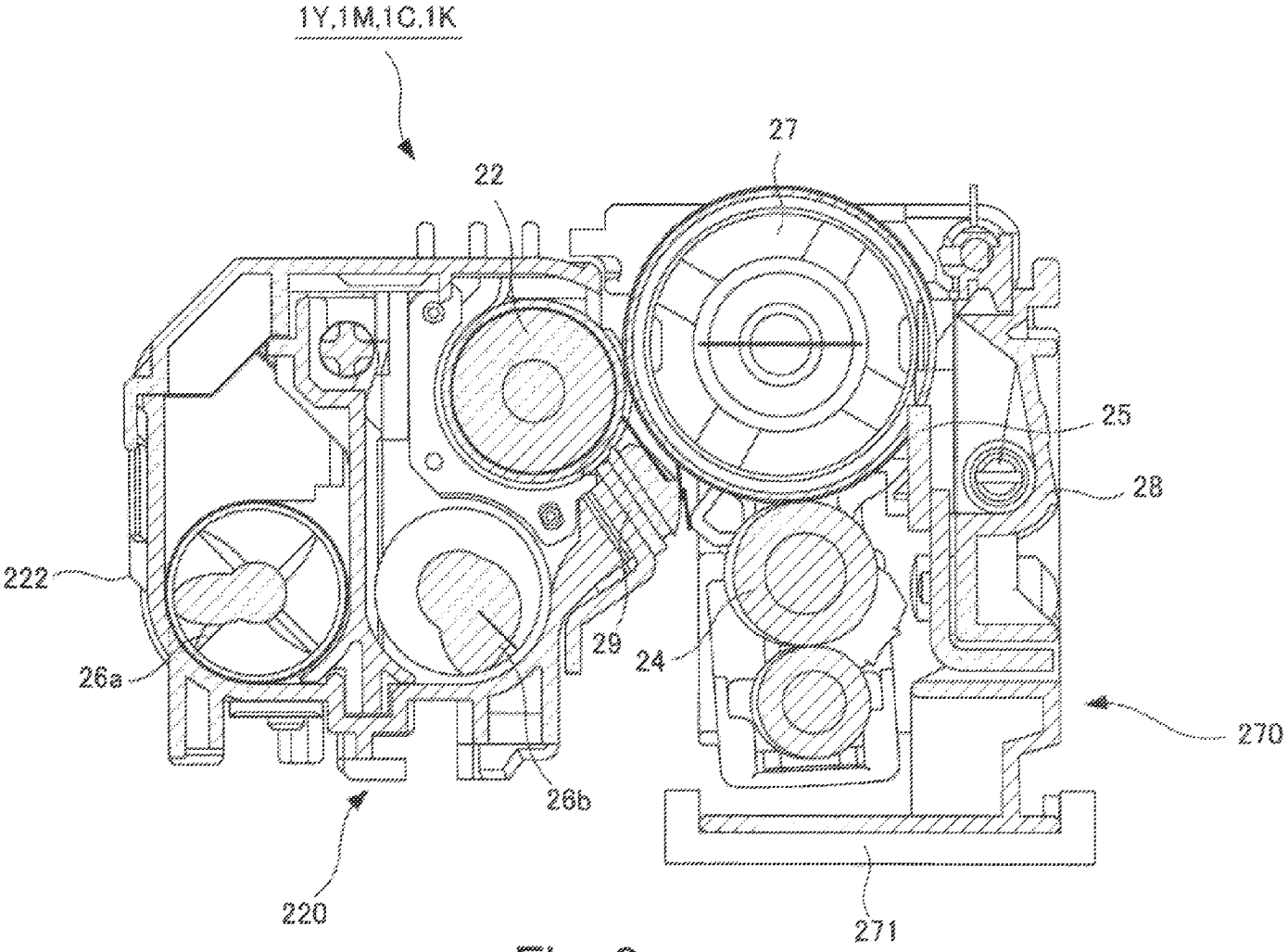
FIG. 3 is an illustration of a cross-section of the image forming portion.

FIG. 2 is a perspective view of an outer appearance of the image forming portion. FIG. 3 is an illustration of a cross-section of the image forming portion. The image forming apparatus employs a cartridge type. In the cartridge type, the photosensitive drum, the developing device, the charging device and the like are integrally assembled into a cartridge in a predetermined combination, and the cartridge is detachably mounted in an apparatus main assembly. According to the cartridge type, maintenance of the image forming apparatus can be performed by a user himself (herself) without relying on a service person, so that operativity of the image forming apparatus 100 and ease of maintenance and repair of the image forming apparatus can be improved.

Examples of the cartridge may include a drum cartridge prepared by integrally assembling the photosensitive drum and the drum cleaning device into a unit. A developing cartridge prepared by integrally assembling a developing sleeve and a toner accommodating container into a unit, a process cartridge of obtained by integrally connecting the drum cartridge and the developing cartridge, and the like cartridge have also been known. As shown in FIG. 2, each of the image forming portions 1Y, 1M, 1C and 1K is constituted by connecting the developing cartridge 220 with a drum cartridge 270. The drum cartridge 270 and the developing cartridge 220 are individually exchangeable.

As shown in FIG. 3, the drum cartridge 270 forms an exchangeable unit in which the photosensitive drum 27, the charging roller 24 and the cleaning blade 25 are accommodated in a photosensitive drum container 28 and are integrally mounted and demounted. The photosensitive drum 27 and the charging roller 24 are secured to the photosensitive drum container 28 in a state of being pressed against the photosensitive drum 27.

The photosensitive drum 27 is drive-transmitted frost a driving source (not shown) of the image forming apparatus 100 through a coupling which is provided at a rear surface and which is insertable and removable, and thus is rotated. The charging roller 24 is rotated by rotation of the photosensitive drum 27. The photosensitive drum 27, the charging roller 24 and the cleaning blade 25 are gradually lowered in performance when image formation is cumulatively effected, and therefore the drum cartridge 270 is exchanged when a degree of the lowering in these performances reaches a predetermined stage. For this reason, the drum cartridge 270 has such a constitution that the drum cartridge 270 is exchangeable by being pulled out toward a front side of the image forming apparatus 100.

(Developing Cartridge)

As shown in FIG. 3, the developing cartridge 220 is a developing device of two-component type using a two-component developer. Inside a developing container 222, a developing sleeve 22 for developing the electrostatic linage into the toner image is provided opposed to the photosensitive drum 27 with a gap. The developing sleeve 22 rotates while carrying a magnetic chain of the toner, and develops the electrostatic image, formed on the photosensitive drum 27, at a developing position where the photosensitive drum 27 and the developing sleeve 22 oppose each other.

The developing container 222 is provided with bearings for rotatably supporting ends of feeding screws 26*a*, 26*b*. Each of the feeding screws 26*a*, 26*b* circulates and charges the developer in the developing container 222 while stirring the developer, and supplies the developer to the developing sleeve 22.

The developing container 222 is provided with a developing blade 29 for regulating a layer thickness of the developer on the developing sleeve 22 at a certain level. A gap (SB gap) between the developing sleeve 22 and the developing blade 29 is precisely adjusted in a manufacturing step.

Similarly as in the case of the drum cartridge 270, the developing cartridge 220 is exchanged when a degree of a lowering in performance reaches a predetermined stage. For this reason, also the developing sleeve 22 has such a constitution that the developing sleeve 22 is exchangeable by being pulled out toward the front side of the image forming apparatus 100.

(Spacing Operation of Developing Cartridge)

Figure 4:
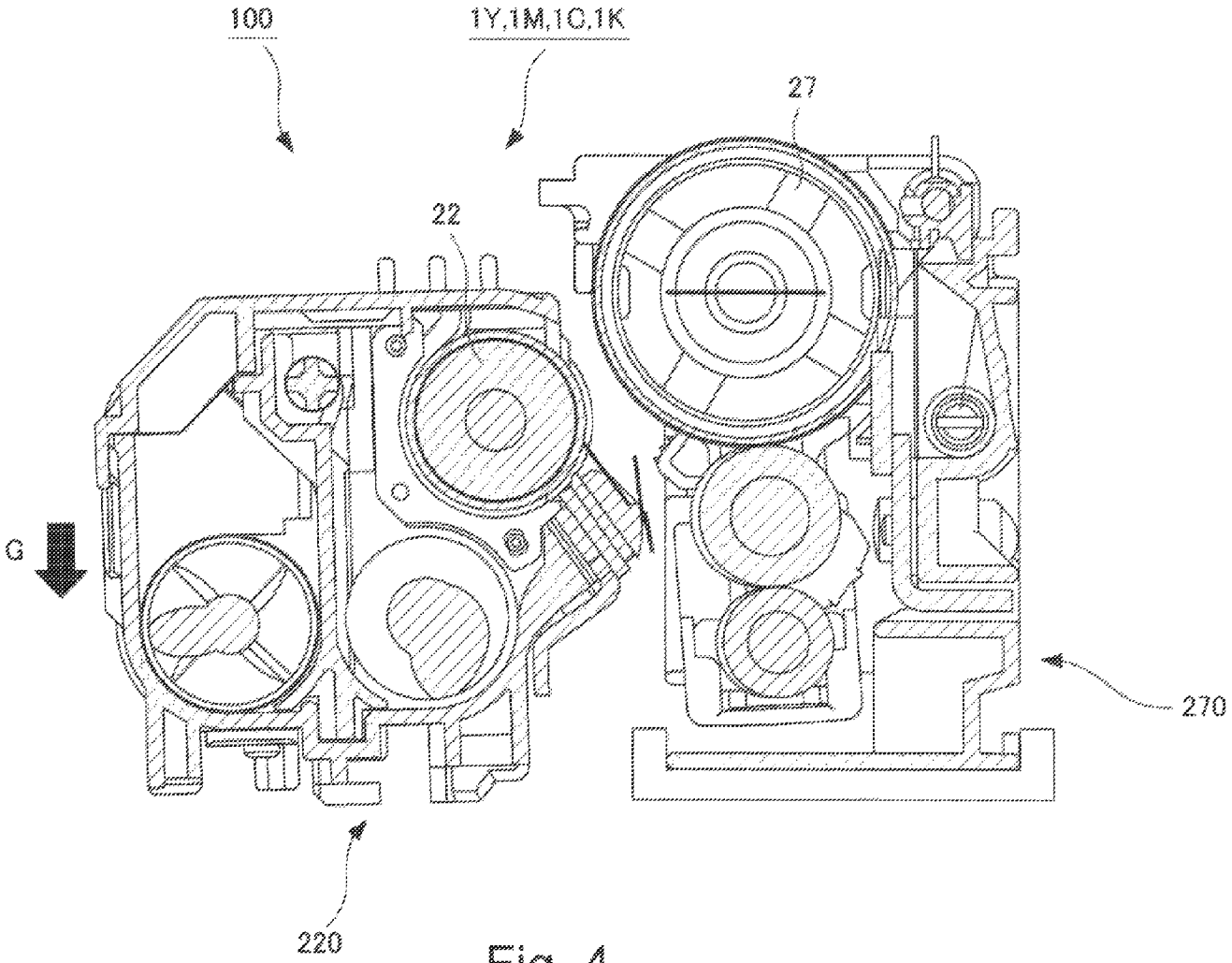
FIG. 4 is an illustration of a spacing operation before exchange (replacement) of a developing cartridge.
Figure 5:
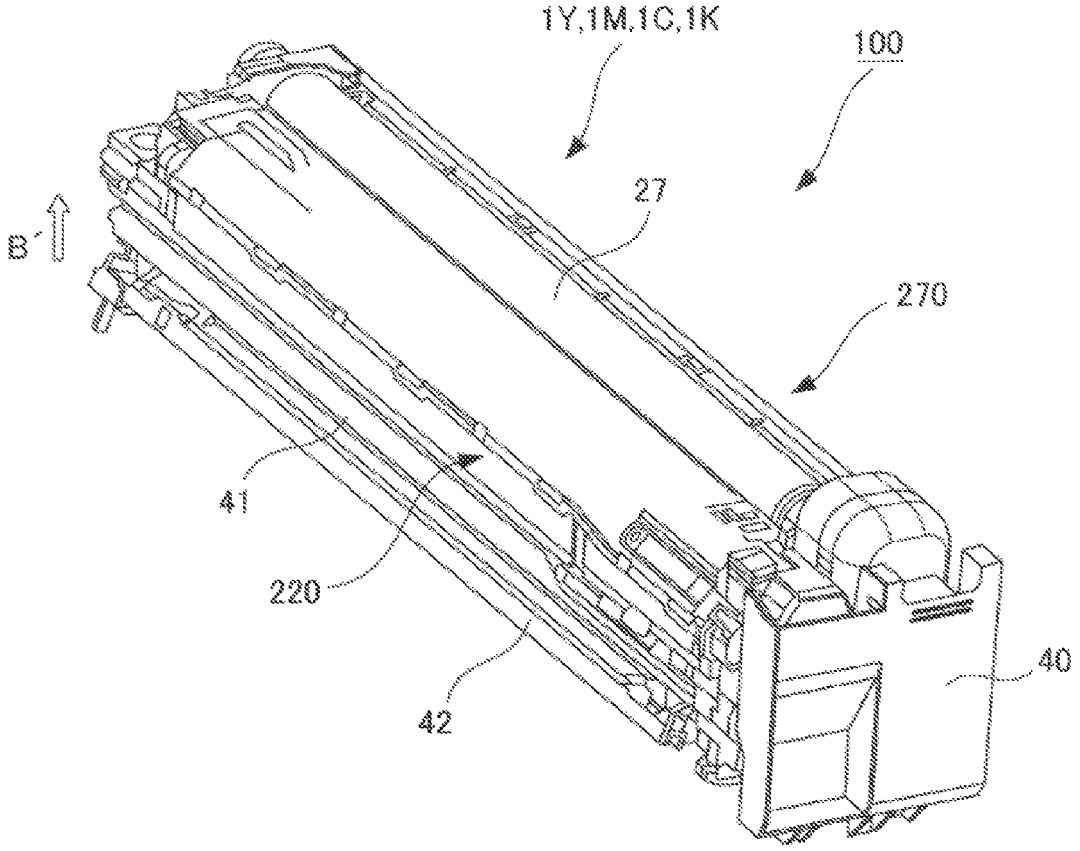
FIG. 5 is a perspective view of a state before exchange of the developing cartridge and a drum cartridge.
Figure 6:
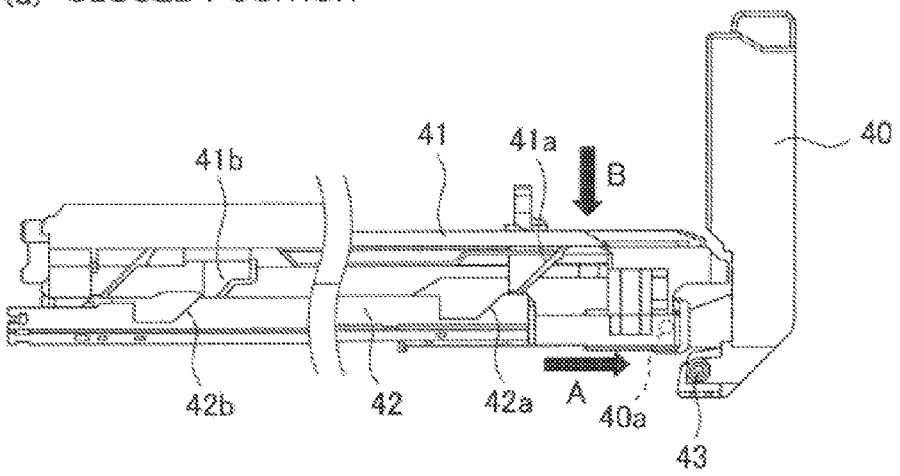
FIG. 6, (a) and (b) are illustrations of an operation of a spacing mechanism for the developing cartridge.
Figure 6:
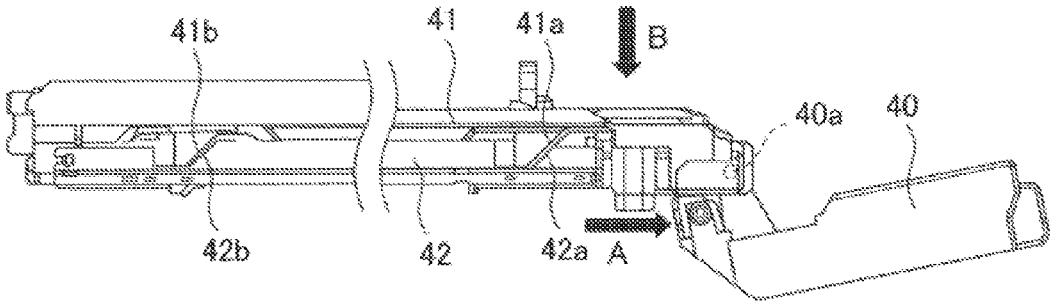
Figure 7:
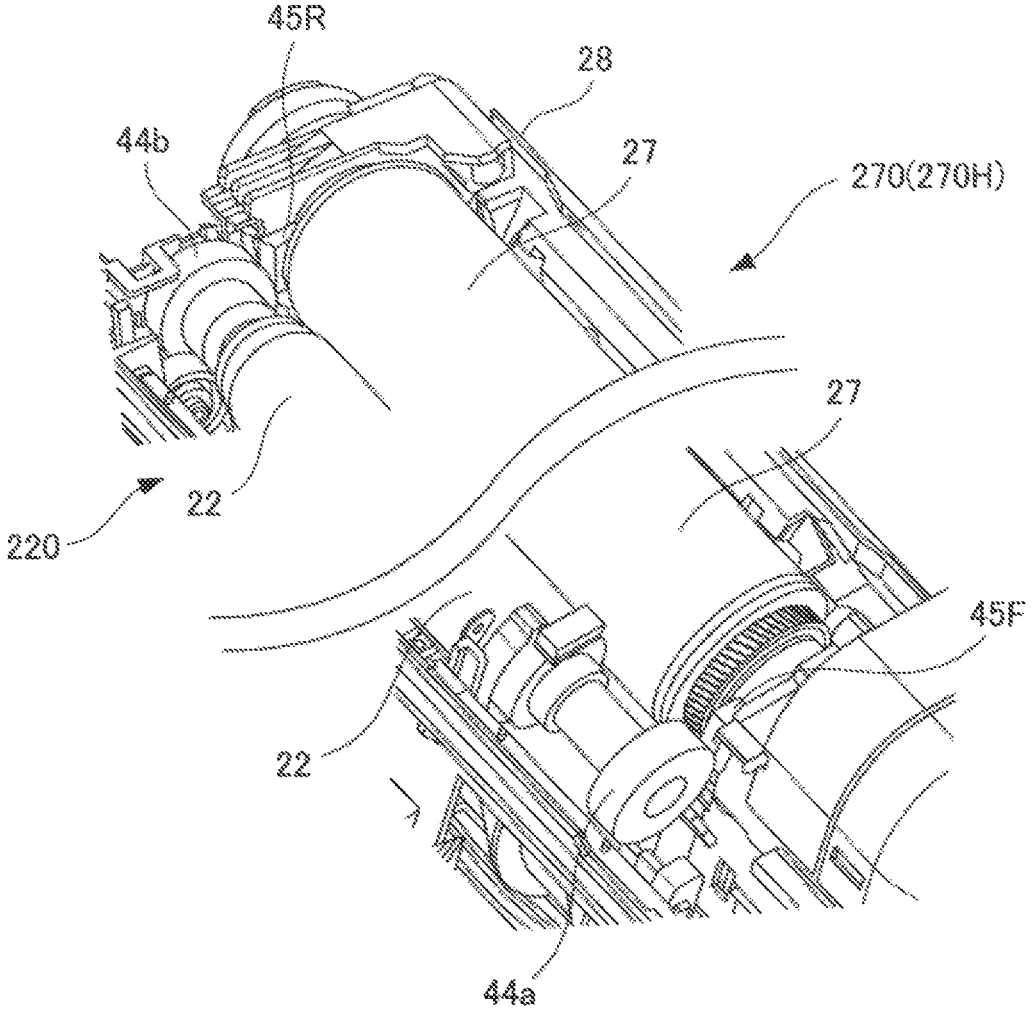
FIG. 7 is an illustration of a state in which the developing cartridge is positioned relative to the drum cartridge.

FIG. 4 is an illustration of a spacing operation before exchange (replacement) of a developing cartridge. FIG. 5 is a perspective view of a state before exchange of the developing cartridge and a drum cartridge. In FIG. 6, (a) and (b) are illustrations of an operation of a spacing mechanism for the developing cartridge. FIG. 7 is an illustration of a state in which the developing cartridge is positioned relative to the drum cartridge. In FIG. 6, (a) shows a closed state of a small door, and (b) shows an open state of the small door.

As shown in FIG. 3, in each of the image forming portions 1Y, 1M, 1C, 1K, the photosensitive drum 27 of the drum cartridge 270 and the developing sleeve 22 of the developing cartridge 220 are opposed to each other via a narrow spacing (SD gap). For this reason, when the dress cartridge 270 is pulled out, it is preferable that the developing cartridge 220 is retracted in a direction in which the developing sleeve 22 is spaced from the photosensitive drum 27. When the developing cartridge 220 is pulled out as it is toward the front side of the image forming apparatus 100, there is a possibility that the photosensitive drum 27 is damaged by sliding of the developing cartridge 220 on the photosensitive drum 27. Therefore, as shown in FIG. 6, in the image forming apparatus 100, in advance of the pulling-out of the developing cartridge 220, the developing cartridge 220 is moved in an arrow G direction (vertically downward) relative to the drum cartridge 270, and thus is spaced from the photosensitive drum 27.

As shown in FIG. 5, in a front side of the developing cartridge 220 and the drum cartridge 270, a small door 40 which is an example of a door member is provided every one of the image forming portions 1Y, 1M, 1C, 1K. In a state in which the small door is closed, both of the developing cartridge 220 and the drum cartridge 270 cannot be accessed. The small door 40 constitutes an operation portion not only for preventing such an erroneous operation that the developing cartridge 220 is pulled out as it is toward the front side but also for moving the developing cartridge 220 vertically downward in interrelation with an operation by which the small door 40 itself is opened.

As shown in (a) of FIG. 6, the developing cartridge 220 is supported by a developing rail 41 so as to be pullable out toward the front side. The developing rail 41 is held at a raised position by a spacing link 42, and the spacing link 42 is mechanistically connected with the small door 40.

The small door 40 is rotatable about a rotation shaft 43. The small door 40 is fastened to the spacing link 42 by a link shaft 40*a* provided near the rotation shaft 43. At an upper surface of the spacing link 42, recessed portions 42*a*, 42*b* are provided. At a lower surface of the developing rail 41, foot portions 41*a*, 41*b* are provided.

As shown in (b) of FIG. 6, an opening operation of the small door 40 acts as a trigger for the spacing of the developing cartridge 220. When the small door 40 rotates in the clockwise direction about the rotation shaft 43, the link shaft 40*a* moves in the arrow A direction, so that the spacing link 42 is pulled out in the arrow A direction and thus the foot portions 41*a*, 41*b* engage with the recessed portions 42*a*, 42*b*, respectively. When the spacing link 42 moves in the arrow A direction, inclined surfaces of the foot portions 41*a*, 41*b* gently slide down along inclined surfaces of the recessed portions 42*a*, 42*b*, respectively, so that the developing rail 41 moves in an arrow B direction. A height of the developing rail 41 lowers, so that the developing cartridge 220 moved downward vertically. The arrow B direction in which the developing cartridge 220 moves and an amount of movement of the developing cartridge 220 correspond to a spacing direction of the developing cartridge 220 and a spacing amount of the developing cartridge 220, respectively.

As shown in (b) of FIG. 6, when the small door 40 is in an open state, the developing cartridge 220 is in a position spaced from the adjacent drum cartridge 270 as shown in FIG. 4. For this reason, the developing cartridge 220 can be removed from the image forming apparatus 100 toward the front side and can be inserted from the front side into the image forming apparatus 100 without damaging the photosensitive drum 27. When the small door 40 is in a spaced, also the drum cartridge 270 can be removed from the inserted into the image forming apparatus 100 without damaging the photosensitive drum 27.

As shown in FIG. 5, by an unshown urging means, the developing cartridge 220 is urged toward the drum cartridge 270 via the developing rail 41. As a result, as shown in FIG. 7, developing sleeve bearings 44*a*, 44*b* abut against photosensitive drum bearings 45F, 45R, respectively, so that the gap (SD gap) between the developing sleeve 22 and the photosensitive drum 27 is ensured. In this state, the position of the developing cartridge 220 with respect to a height direction is determined.

As shown in FIG. 7, the photosensitive drum 27 is rotatably supported by a photosensitive drum bearing 45R mounted on a rear side of the photosensitive drum container 28 and a photosensitive drum bearing 45F mounted on a front side of the photosensitive drum container 28. The developing sleeve 22 is rotatably supported by a developing sleeve bearing 44*b* mounted on a rear side of the developing cartridge 220 and a developing sleeve bearing 44*a* mounted on a front side of the developing cartridge 220.

The photosensitive drum bearing 45R is abutted against an outer race of the developing sleeve bearing 44*b* of the developing sleeve 22, and the photosensitive drum bearing 45F is abutted against an outer race of the developing sleeve bearing 44*a* of the developing sleeve 22. As a result, uniformity of the gap between the developing sleeve 22 and the photosensitive drum 27 along the rotational axis of the photosensitive drum 27 is ensured. For this reason, the photosensitive drum bearing 45R on the rear side of the photosensitive drum 27 is provided with a projected shaped portion 45*c* to be abutted against the developing sleeve bearing 44 on the developing sleeve 22 side.

As described above, the developing cartridge 220 which is an example of a developing unit includes the developing sleeve 22 which is an example of a developer carrying member, the developing sleeve bearing 44*b* which is an example of a first circumferential portion, and the developing sleeve bearing 44*a* which is an example of a second circumferential portion. Each of the circumferential portions in Embodiment 1 is a bearing member for rotatably supporting the developing sleeve 22. Recessed portions 42*a*, 42*b* are foot portions 41*a*, 41*b* which are an example of a moving mechanism move the developing cartridge 220 in a direction in which the developing sleeve 22 is spaced from the photosensitive drum 27.

The drum cartridge 270 which is an example of an image bearing member unit is adjacent to the developing cartridge 220 and is movably mounted in a main assembly casing of the image forming apparatus. The drum cartridge 270 is insertable into and removable from the main assembly casing by being mowed in the demounting direction along the rotational axis of the photosensitive drum 27.

(Photosensitive Drum Bearing)

Figure 8:
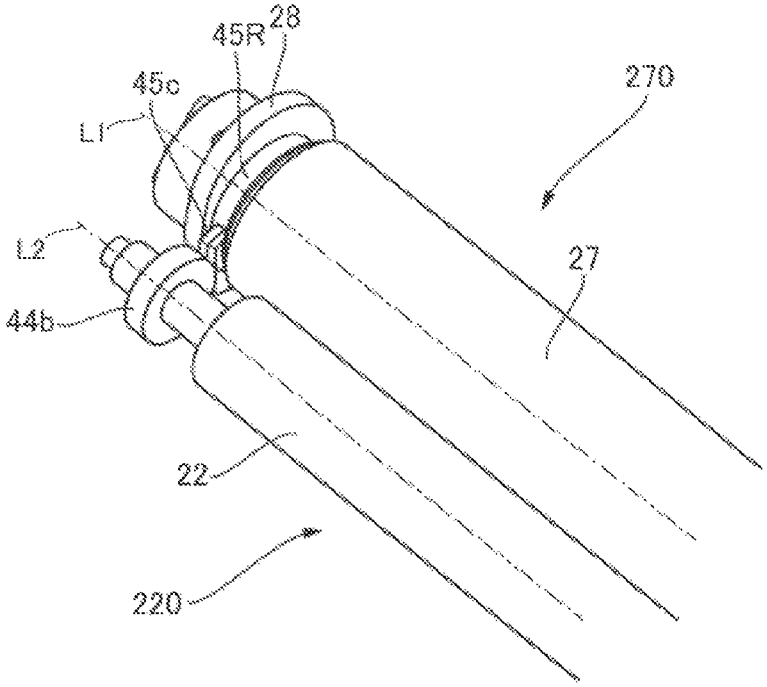
FIG. 8 is an illustration of an assembled state of a bearing structure of a rear-side end portion of a photosensitive drum.
Figure 9:
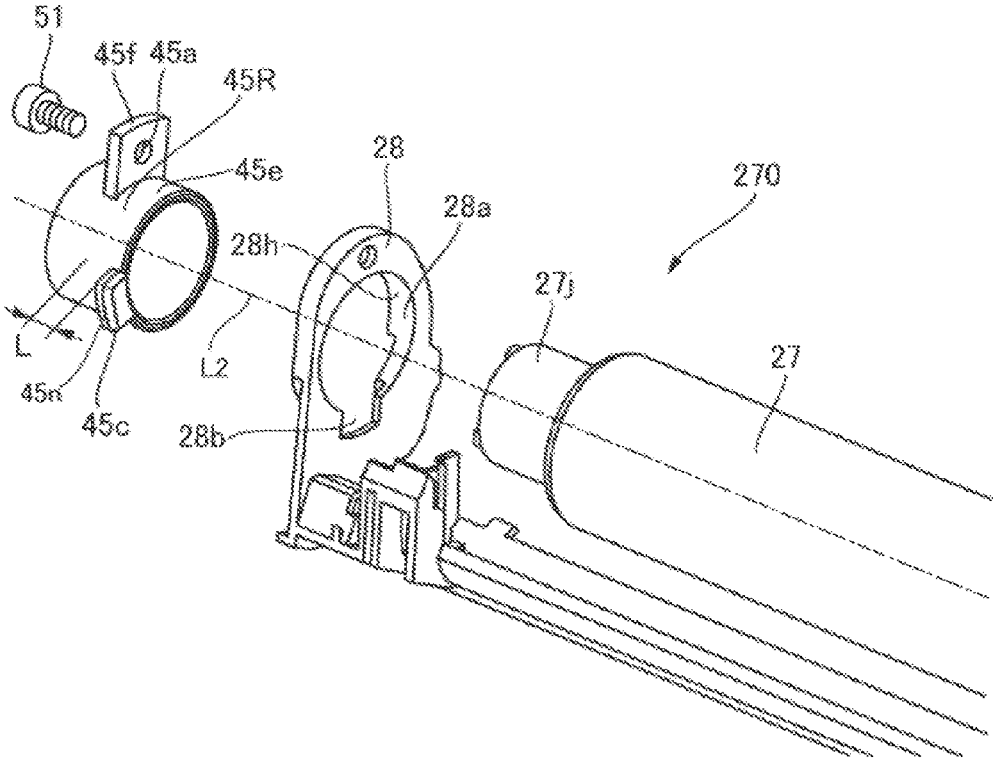
FIG. 9 is an illustration of a disassembled state of the bearing structure of the rear-side end portion of the photosensitive drum.

FIG. 8 is an illustration of an assembled state of a bearing structure at a rear-side end portion of the photosensitive drum. FIG. 9 is an illustration of a disassembled state of the bearing structure at the rear-side end portion of the photosensitive drum. In the following description, an angular position of the photosensitive drum 27 about the rotational axis as seen from the rotational axis direction of the photosensitive drum 27 is defined as a phase, and an angular range is defined as a phase range.

As shown in FIG. 8, the photosensitive drum bearing 45R which is an example of a bearing portion and a first bearing portion rotatably supports the photosensitive drum 27 at a rear-side end portion of the drum cartridge 270. The photosensitive drum bearing 45R is capable of regulating the gap between the photosensitive drum 27 and the developing sleeve 22 by bringing a free end of the projected shaped portion 45*c* which is an example of an arcuate portion into contact with the developing sleeve bearing 44*b* which is an example of a circumferential surface.

As shown in FIG. 9, the projected shaped portion 45*c* forms a circumferential part of a circle which is coaxial with the rotational axis of the photosensitive drum 27 and which is larger than the photosensitive drum 27. At the free end of the projected shaped portion 45*c*, an arcuate edge line 45*n* about a second rotational axis L2 is provided.

On the other hand, the photosensitive drum container 28 which is an example of a holding portion is provided with a drum bearing mounting hole 28*a* which is an example of an opening, through which the photosensitive drum bearing 45R is insertable in the rotational axis direction, where the photosensitive drum bearing 45R is held. A key groove shaped portion 28*b* permits passage of the projected shaped portion 45*c* therethrough in the rotational axis direction.

The drum bearing mounting hole 28*a* includes the key groove shaped portion 28*b* which is an example of a passing portion which is recessed outwardly in a radial direction more than an inner peripheral surface 28*b* and which permits the passage of the projected shaped portion 45*c* therethrough in the rotational axis direction. At this time, the key groove shaped portion 28*b* is provided so that a phase of the projected shaped portion 48*c* when the photosensitive drum bearing 45R is mounted at a normal position and a phase where the photosensitive drum container 28 is provided with the key groove shaped portion 28*b* are different from each other.

The key groove shaped portion 28*b* is formed downwardly, not toward the developing sleeve 22. The photosensitive drum bearing 45R is inserted into the drum bearing mounting hole 28*a* in a state in which the projected shaped portion 45*c* is directed downwardly. After the insertion, the projected shaped portion 45*c* is rotated by about 70° and is moved to a position of FIG. 8, and then is fixed to the photosensitive drum container 28 with a screw 51.

A flange portion 45*f* which is an example of a flange portion projects in the radial direction at a position spaced from the projected shaped portion 45*c* in the rotational axis direction. The projected shaped portion 45*c* is disposed inside the drum bearing mounting hole 28*a* and outside the photosensitive drum 27 which is an example of an image bearing member, and the flange portion 45*f* is disposed on a side (in an outside space) opposite from the projected shaped portion 45*c* with respect to the drum bearing mounting hole 28*a*. The flange portion 45*f* is threadably fixed in the photosensitive drum container 28.

In Embodiment 1, the projected shaped portion 45*c* is positioned relative to the key groove shaped portion 28*b*, and the photosensitive drum bearing 45R is inserted into the drum bearing mounting hole 28*a* and then is rotated to determine a direction thereof. Thereafter, the photosensitive drum hearing 45R is fixed to the photosensitive drum container 28.

(Comparison Examples)

Figure 10:
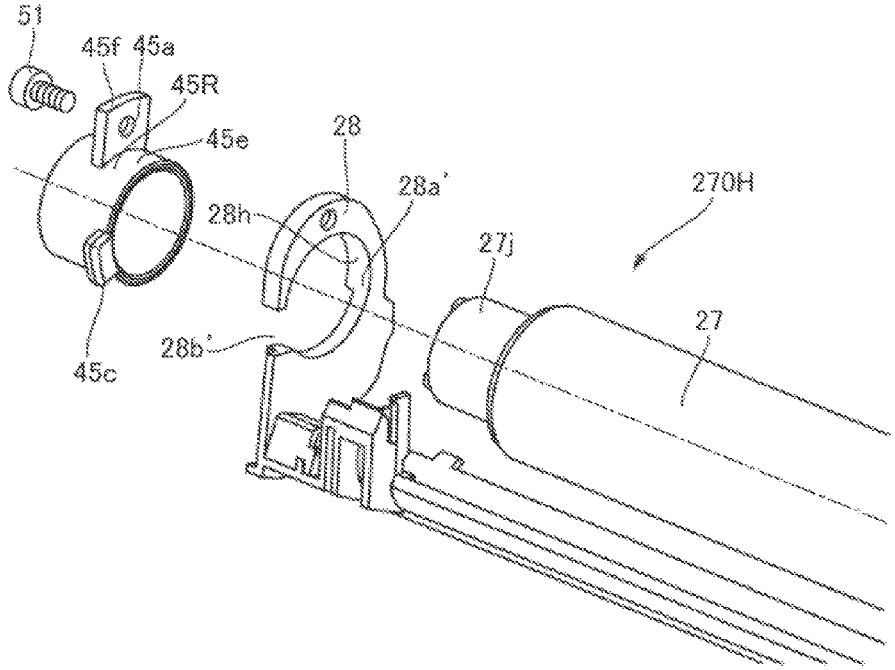
FIG. 10 is an illustration of a bearing structure of a drum cartridge in Comparison Example 1.
Figure 11:
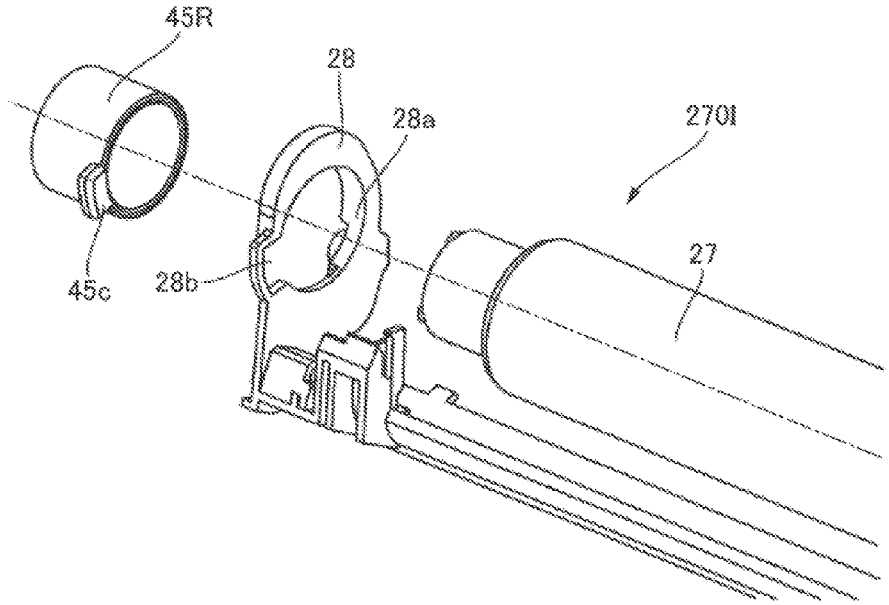
FIG. 11 is an illustration of a bearing structure of a drum cartridge in Comparison Example 2.
Figure 12:
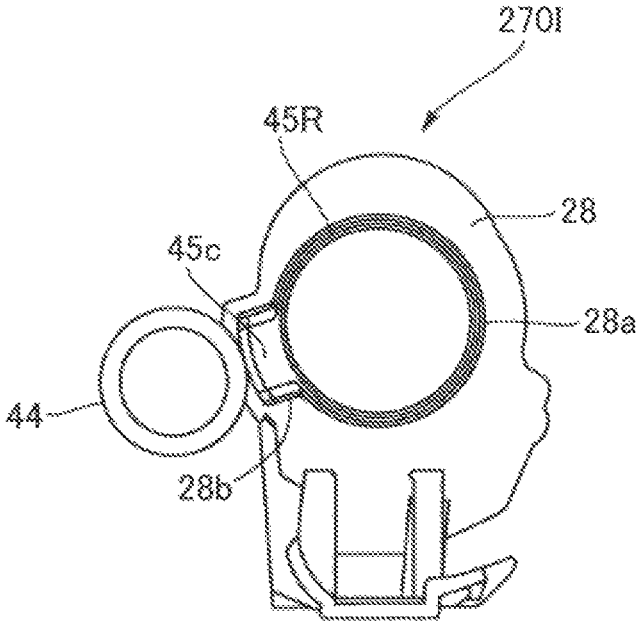
FIG. 12 is an illustration of an interference between the drum cartridge and a developing sleeve in Comparison Example 2.

FIG. 10 is an illustration of a bearing structure in a drum cartridge in Comparison Example 1. FIG. 11 is an illustration of a bearing structure in a drum cartridge in Comparison Example 1. FIG. 12 is an illustration of an interference between the drum cartridge and a developing sleeve in Comparison Example 2.

A drum cartridge 270H in Comparison Example 1 is, similarly as in Embodiment 1 shown in FIG. 3, constituted by mounting the photosensitive drum 27, the charging roller 24 and the cleaning blade 25 to the photosensitive drum container 28.

As shown in FIG. 7, the photosensitive drum 27 of the drum cartridge 270H in Comparison Example 1 is rotatably supported at end portions by the photosensitive drum bearings 45R, 45F. As shown in FIG. 8, the photosensitive drum bearing 45R is provided with the projected shaped portion 45*c* which projects toward the developing sleeve 22 and which abuts against the developing sleeve bearing 44*b*. The projected shaped portion 45*c* has such a projected shape that the projected shaped portion 45*c* projects from an outer peripheral surface of the photosensitive drum bearing 45R in the direction toward the developing cartridge 220.

As shown in FIG. 10, the drum cartridge 270H in Comparison Example 1 is provided with an opening part 28*b*' at a drum bearing mounting hole 28*a*' of the photosensitive drum container 28. For this reason, the photosensitive drum bearing 45R is inserted into the drum bearing mounting hole 28*a*' while keeping an angular position where the projected shaped portion 45*c* is directed toward the developing sleeve 22, and thereafter is fixed to the photosensitive drum container 28 with the screw 51.

The drum cartridge 270H in Comparison Example 1 is pullable out in the rotational axis direction of the photosensitive drum 27. However, the drum cartridge 270H in Comparison Example 1 is provided with the opening part 28*b*' at the drum bearing mounting hole 28*a*' of the photosensitive drum container 28, and therefore dimension accuracy of the opening part 28*b*' lowers. Further, the photosensitive drum bearing 45R mounted at the opening part 28*b*' generates a lean and causes rotation non-uniformity and vibration of the photosensitive drum 27. In addition, strength of the photosensitive drum container 28 in the neighborhood of the drum bearing mounting hole 28*a*' lowers by the opening part 28*b*'.

As shown in FIG. 11, a drum cartridge 270I in Comparison Example 2 is provided with a key groove shaped portion 28*b* toward the developing sleeve 22 at a drum bearing mounting hole 28*a*. The key groove shaped portion 28*b* causes the projected shaped portion 45*c* to escape from contacting the photosensitive drum container 28 during insertion of the photosensitive drum bearing 45R into the drum bearing mounting hole 28*a* and thus causes the projected shaped portion 45*c* to pass therethrough with no interference therewith. In the drum bearing mounting hole 28*a* in Comparison Example 2, the photosensitive drum container 28 is extended toward an outside of the opening part 28*b*' in Comparison Example 1, so that an outer peripheral portion of the photosensitive drum container 28 is connected outside the opening part 28*b*' in Comparison Example 1.

In the drum cartridge 270I in Comparison Example 2, the drum bearing mounting hole 28*a* is not provided with the opening part (28*b*' in FIG. 10), and therefore the above-described problem such as the lowering in strength does not generate. However, a contour shape of the photosensitive drum container 28 as seen from the rotational axis direction becomes larger toward the developing cartridge 220 than a contour shape if the photosensitive drum container 28 of the drum cartridge 270H in Comparison Example 1 in which the opening part 28*b*' is provided.

As shown in FIG. 12, the drum cartridge 270I is provided with the key groove shaped portion 28*b* toward the developing sleeve 22, and therefore a side plate portion where the drum bearing mounting hole 28*a* of the photosensitive drum container 28 is provided projects toward the developing cartridge 220. As a result of an increase in contour shape of the photosensitive drum container 28 toward the developing cartridge 220, the drum cartridge 270I interferes with the developing cartridge 220 in a pulling-out process. For this reason, in a state in which the developing cartridge 220 is mounted in the apparatus main assembly of the image forming apparatus 100, the drum cartridge 270I cannot be independently pulled out. When the drum cartridge 270I is pulled out toward the front side, the developing sleeve 22 and the photosensitive drum 27 are liable to be damaged by sliding.

Incidentally, also when the drum cartridge 270H in Comparison Example 1 is inserted into and removed from the apparatus main assembly of the image forming apparatus 100, in order to prevent contact with the developing cartridge 220, the developing cartridge 220 is retracted. For this reason, also in the drum cartridge 270I in Comparison Example 2, the drum cartridge 220 is retracted, so that there is a possibility that the drum cartridge 270H can be inserted and removed without interfering with the developing cartridge 220.

However, when the contour shape of the photosensitive drum container 28 increases toward the developing cartridge 220, there is a need to increase a retraction amount of the developing cartridge 220, so that the image forming apparatus 100 increases in size. In order to avoid the interference with the side plate portion of the photosensitive drum container 28 projecting toward the developing cartridge 220, a large spacing amount of the developing cartridge 220 is required. As a result, the large spacing amount leads to upsizing of the image forming apparatus 100.

Therefore, as shown in FIG. 9, in Embodiment 1, the key groove shaped portion 28*b* provided to the drum bearing mounting hole 28*a* of the photosensitive drum container 28 is provided at a position other than the position toward the developing cartridge 220. The photosensitive drum tearing 45R is inserted into the drum bearing mounting hole 28*a* and then is rotated, so that the projected shaped portion 45*c* is positioned toward the developing cartridge 220. A constitution in which the key groove shaped portion 28*b* of the drum bearing mounting hole 28*a* of the photosensitive drum 28 is provided at the position other than the position toward the developing sleeve 22 and in which the photosensitive drum bearing 45R is inserted into the drum bearing mounting hole 28*a* and then is rotated was employed.

(Mounting Procedure of Drum Cartridge)

Figure 13:
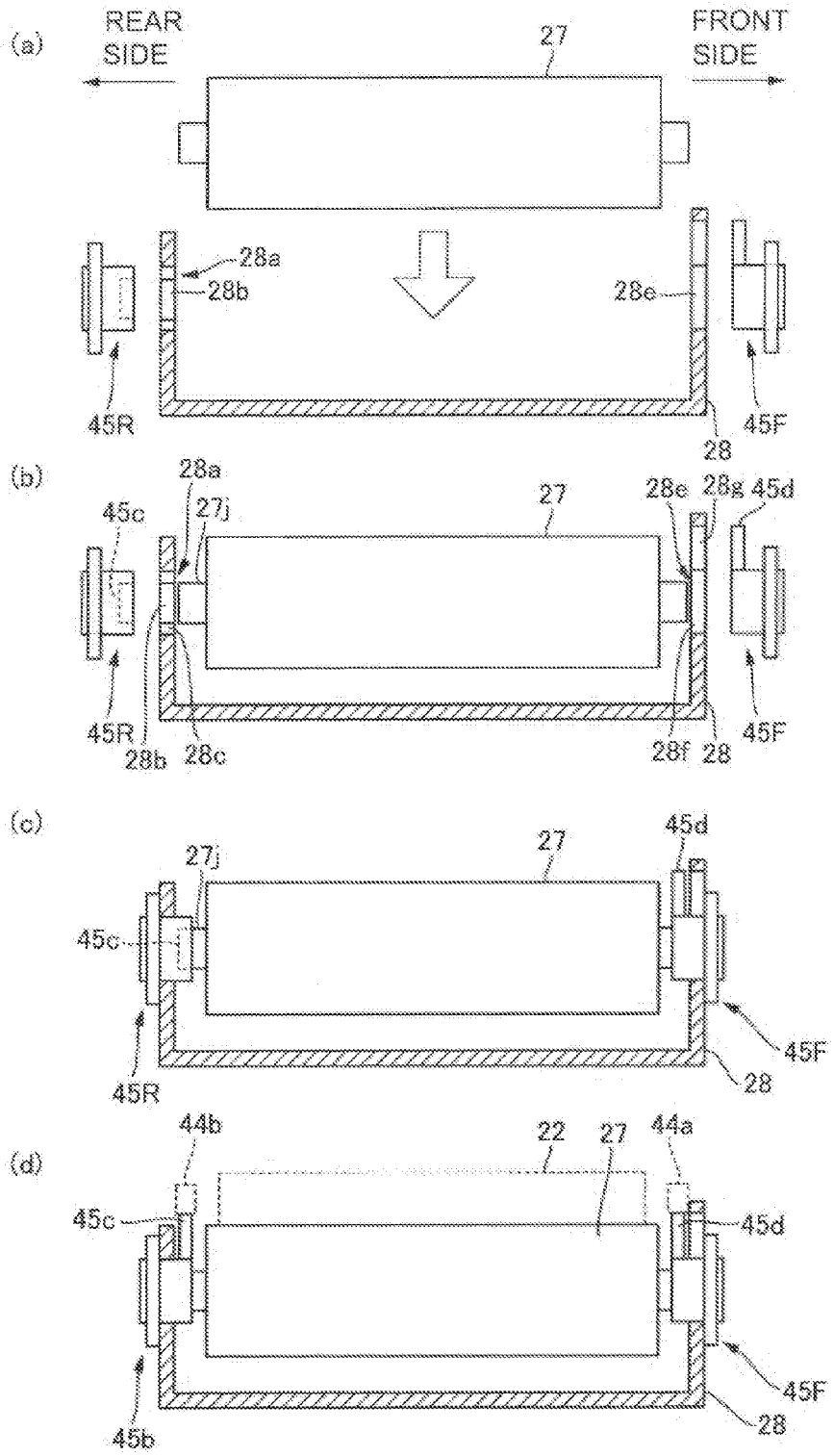
In FIG. 13, (a) to (d) are illustrations of an assembling procedure of the drum cartridge.

In FIG. 13, (a) to (d) are illustrations of a mounting procedure of the drum cartridge.

As shown in (a) of FIG. 13, the photosensitive drum 27 is moved from a direction perpendicular to the rotational axis thereof, and is positioned at a mounting position relative to the photosensitive drum container 28.

As shown in (b) of FIG. 13, the photosensitive drum bearings 45F, 45R are inserted into the drum bearing mounting holes 28*a*, 28*e* of the photosensitive drum container 28. At this time, on the rear side, the projected shaped portion 45*c* is directed downward correspondingly to the position of the key groove shaped portion 28*b*. In the front side, a projected shaped portion 45*d* is directed toward the developing sleeve (22 in FIG. 3) correspondingly to a position of a key groove shaped portion 28*g*.

As shown in (c) of FIG. 13, when the photosensitive drum bearings 45F, 45R are inserted into the drum bearing mounting holes 28*a*, 28*e*, at the same time, the rotation shaft 27*j* of the photosensitive drum 27 is inserted into the photosensitive drum bearings 45, 45R.

As shown in (d) of FIG. 13, after the assembling, the projected shaped portion 45*c* is disposed in an inside space of the photosensitive drum container 28, and the flange portion 45*f* is disposed in an outside space of the photosensitive drum container 28 and then is fixed to the photosensitive drum container 28 with the screw. The projected shaped portions 45*c*, 45*d* contact the outer races of the developing sleeve bearings 44*a*, 44*b*.

In a direction from the rotational axis of the photosensitive drum 27 toward the developing sleeve 22, the outer peripheral surface of the photosensitive drum container 28 is positioned closer to the rotational axis than the outer peripheral surface of the projected shaped portion 45*c* (the edge line 45*n*) is. For this reason, the drum cartridge 270 can be pulled out toward the front side without interfering with the developing cartridge 220.

(Rear-Side Drum Bearing Mounting Hole)

Figure 14:
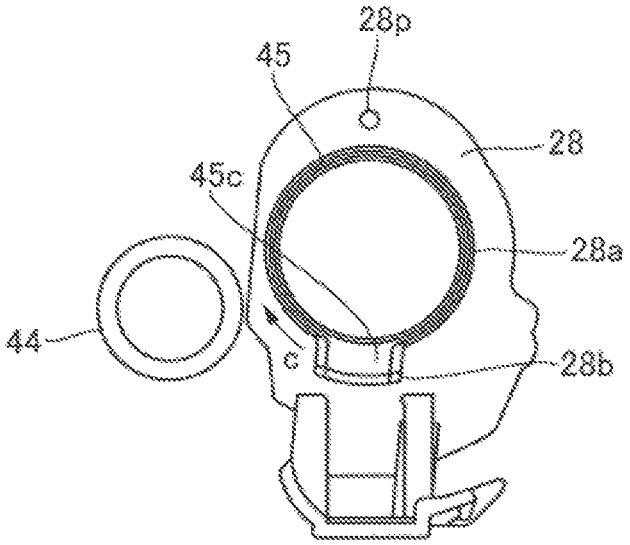
In FIG. 14, (a) and (b) are illustrations of a rear-side photosensitive drum bearing structure of the photosensitive drum.
Figure 14:
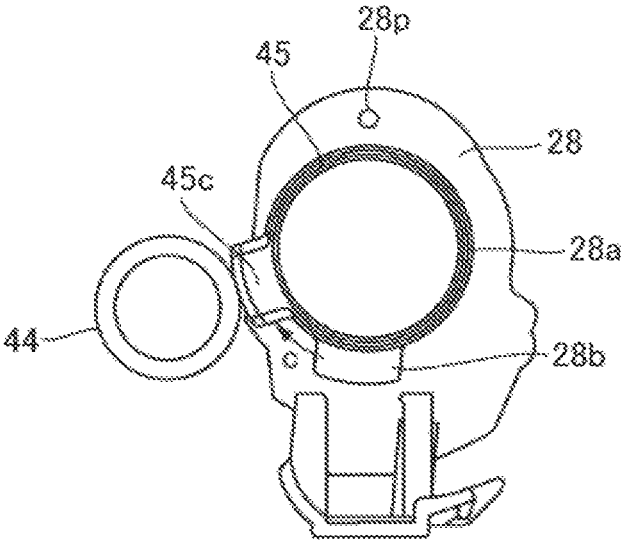

In FIG. 14, (a) and (b) are illustrations of a rear-side photosensitive drum bearing structure of the photosensitive drum, wherein (a) shows a state in which the projected shaped portion is inserted into the drum bearing mounting hole, and (b) shows a state in which the projected shaped portion is rotated toward a normal position after the insertion.

As shown in FIG. 9, the bearing portion 45*e* of the photosensitive drum bearing 45R rotatably supports the rotation shaft 27*i* of the photosensitive drum 27. The projected shaped portion 45*c* is finally mounted so as to project from a bearing portion 28*r* toward the developing sleeve of the developing cartridge in the radial direction. The projected shaped portion 45*c* includes the edge line 45*n* projecting in a ridge shape at a free end thereof, and the edge line 45*n* contacts the developing sleeve bearing (44*b* in FIG. 8).

As shown in FIG. 3, the charging roller 24 which is an example of an executing portion executes a part of an image forming process relative to the photosensitive drum 27. As shown in FIG. 9, as seen from the rotational axis direction, with respect to the key groove shaped portion 28*b*, a phase range where the drum bearing mounting hole 28*a* is provided with the key groove shaped portion 28*b* and a phase range where the charging roller 24 at least partly overlap with each other.

As shown in FIG. 14, the photosensitive drum container 28 is provided with the drum bearing mounting hole 28*a* through which the photosensitive drum bearing 45R is to be mounted. In order to form a high-quality image, there is a need to enhance positional accuracy of the photosensitive drum 27. Rotational accuracy of the photosensitive drum 27 is subjected to the influence of dimensional accuracy of the drum bearing mounting hole 28*a*. For this reason, the bearing portion 45*e* is finished within an engaging tolerance relative to the drum bearing mounting hole 28*a* and is held with no backlash.

In order to enhance the dimensional accuracy of the drum bearing mounting hole 28*a*, the drum bearing mounting hole 28*a* is formed in such a shape that an entire circumferential surface thereof is closed. By forming the drum bearing mounting hole 28*a* in such a shape, rigidity in the neighborhood of the drum bearing mounting hole 28*a* is enhanced, so that in the case where the drum cartridge 270 is subjected to an external force such as vibration or drop, the rotational accuracy is not readily lowered. Also from this fact, it is preferable that the drum bearing mounting hole 28*a* has a shape in which the entire circumferential surface thereof is connected (closed).

The photosensitive drum bearing 45R is provided with the projected shaped portion 45*c* for being abutted against the developing sleeve bearing 44. In order to stabilize gap accuracy between the developing sleeve 22 and the photosensitive drum 27, the projected shaped portion 45*c* may preferably be disposed close to the photosensitive drum 27. For this reason, in this embodiment, the projected shaped portion 45*c* of the photosensitive drum bearing 45R was provided toward the photosensitive drum 27 more than the side plate portion provided with the drum bearing mounting hole 28*a* of the photosensitive drum container 28. Further, the key groove shaped portion 28*b* of the drum bearing mounting hole 28*a* of the photosensitive drum container 28 was provided on a lower side of the drum hearing mounting hole 28*a* relative to the center of the drum bearing mounting hole 28*a* with respect to a substantially vertical direction.

As shown in FIG. 14, during assembling of the photosensitive drum hearing 45R, the photosensitive drum hearing 45R is inserted so that the projected shaped portion 45*c* of the photosensitive drum bearing 45R is moved through the key groove shaped portion 28*b* of the drum bearing mounting hole 28*a* of the photosensitive drum container 28, and then is rotated in an arrow C direction. The photosensitive drum bearing 45R is fixed with the screw (51 in FIG. 9) in a state in which the projected shaped portion 45*c* of the photosensitive drum bearing 45R is moved toward the developing sleeve 22 and then is rotated to a position where the projected shaped portion 45*c* abuts against the developing sleeve bearing 44. The photosensitive drum container 28 is formed so that in a projected plane along the rotational axis direction, a contour of a portion where the projected shaped portion 45*c* in the normal position of the photosensitive drum bearing 45 is positioned is in a position closer to the rotational axis than a contour of the projected shaped portion 45*c* is. For this reason, a contour of the photosensitive drum container 28 facing the developing cartridge 220 is in a position where the photosensitive drum 27 does not interfere with the developing sleeve 22 at the closest position between the photosensitive drum 27 and the developing sleeve 22.

(Front-Side Drum Bearing Mounting Hole)

Figure 15:
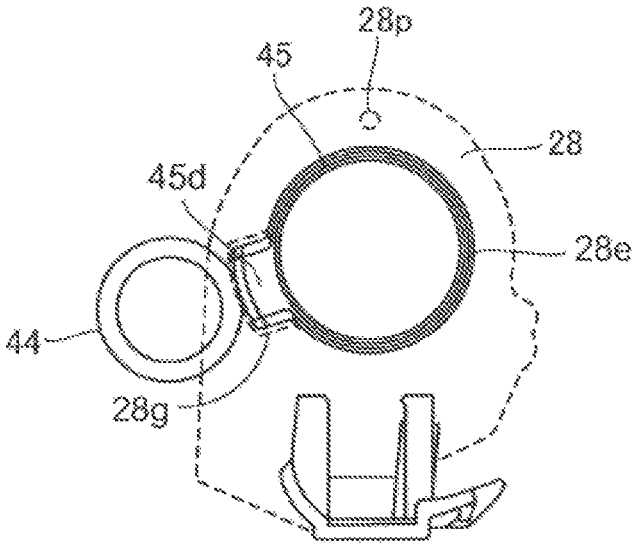
In FIG. 15, (a) and (b) are illustrations of a front-side photosensitive drum bearing structure of the photosensitive drum.
Figure 15:
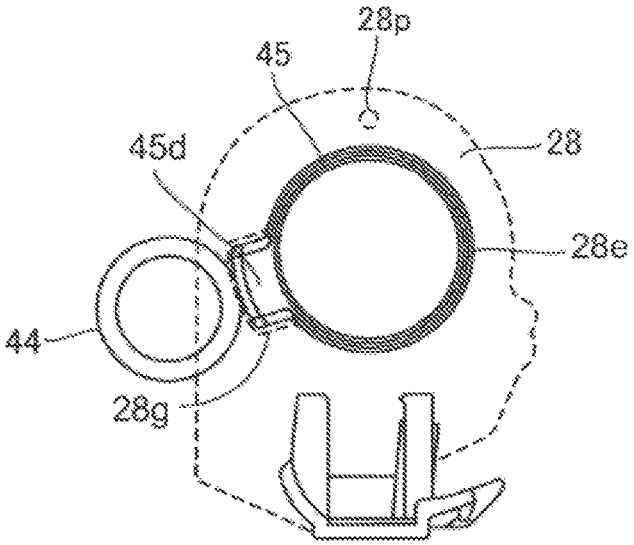

In FIG. 15, (a) and (b) are illustrations of the photosensitive drum bearing structure on the front side of the photosensitive drum. As shown in FIG. 14, the photosensitive drum bearing 45R as the first bearing portion is provided with the projected shaped portion 45*c* as the first arcuate portion, and the photosensitive drum container 28 as the holding portion is provided with the drum bearing mounting hole 28*a* as the first opening.

As shown in FIG. 15, the photosensitive drum bearing 45 which is an example of a second bearing portion rotatably supports the photosensitive drum 27 on a side opposite from the photosensitive drum bearing 45R. The photosensitive drum bearing 45F is coaxial with the photosensitive drum 27 and is provided with the projected shaped portion 45*d* which is an example of a second arcuate portion forming a circumferential part of a circle larger than the photosensitive drum 27. The projected shaped portion 45*d* projects from a bearing portion 45*i* to a position where the projected shaped portion 45*d* is contactable to the outer race or the developing sleeve bearing 44*a*.

The photosensitive drum container 28 as a second holding portion is provided with the drum bearing mounting hole 28*e* which is an example of a second opening. The drum bearing mounting hole 28*e* permits insertion of the photosensitive drum bearing 45F in the rotational axis direction of the photosensitive drum 28 and holds the photosensitive drum bearing 45F at a normal position thereof. A holding portion 28 of the drum bearing mounting hole 28*e* holds the inserted photosensitive drum bearing 45F.

The drum bearing mounting hole 28*e* is provided with the key groove shaped portion 28*g* which is an example of a second passing portion through which the projected shaped portion 45*d* is passable in the rotational axis direction. The key groove shaped portion 28*g* is recessed outwardly more than the holding portion 28*f* in the radial direction, and therefore the projected shaped portion 45*c* can be passed in the rotational axis direction.

The key groove shaped portion 28*g* is provided so that a phase of the projected shaped portion 45*d* when the photosensitive drum bearing 45F is mounted at the normal position thereof and a phase where the drum bearing mounting hole 28*e* is provided with the key groove shaped portion 28*g* are equal to each other. The key groove shaped portion 28*g* is in a phase range including the closest position to the developing sleeve 22 with respect to the circumferential direction of the rotation shaft 27*j*. For this reason, the photosensitive drum bearing 45F is positioned relative to the photosensitive drum container 28 at a position where the photosensitive drum hearing 45F is inserted into the drum bearing mounting hole 28*e*.

The photosensitive drum bearing 45F and the drum bearing mounting hole 28*e* are disposed on the front side with respect to the removing (demounting) direction of the drum cartridge 270, and the photosensitive drum bearing 45R and the drum bearing mounting hole 28*a* are disposed on the rear side with respect to the removing direction of the drum cartridge 270.

(Angular Position of Key Groove Shaped Portion)

Figure 16:
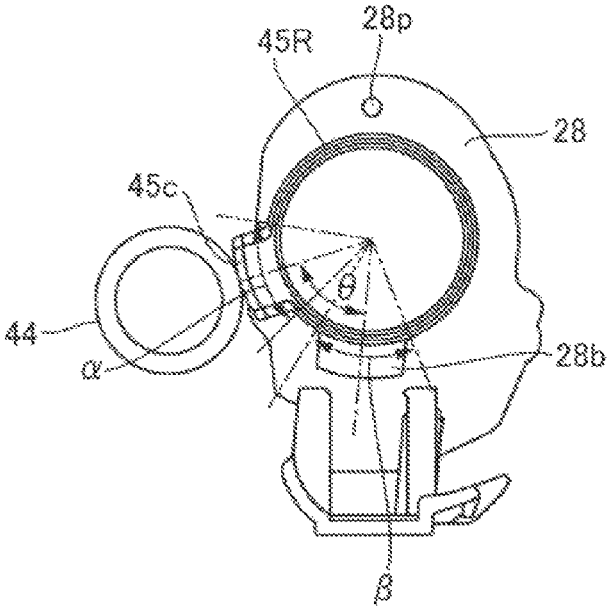
FIG. 16 is an illustration of an angular range in which a key groove shaped portion is provided.

FIG. 16 is an illustration of an angular range in which the key groove shaped portion is provided. The position of the key groove shaped portion 28*b* of the drum bearing mounting hole 28*a* is not limited to the position shown in FIG. 14.

As shown in FIG. 16, when an angular position about the rotational axis as seen from the rotational axis direction of the photosensitive drum is defined as a phase and an angular range is defined as a phase range, an angle of a phase range where the projected shaped portion 45*c* is formed is α and an angle of a phase range where the key groove shaped portion 28*b* is formed is β. Further, an angle formed between a bisector of the phase range with the angle α and a bisector of the phase range with the angle β in a state in which the photosensitive drum bearing 45R is mounted at the normal position is θ. In this case, $\alpha<\beta$ and $\beta/2<\theta$ are satisfied.

The contact portion between the projected shaped portion 45*c* and the developing sleeve bearing 44 may preferably be provided on the bisector of the phase range with the angle α. At this time, the angle θ may preferably be larger than the angle β. That is, $\alpha<\beta<\theta<180°$ is satisfied. As a result, the rigidity of the photosensitive drum container 28 can be further enhanced. However, when the angle θ is excessively large, it is difficult to accommodate the key groove shaped portion 28*b* in a space around the drum bearing mounting hole 28*a* of an already-existing developer container, and therefore $45°<\theta<130°$ is preferable and 60°<θ120° is further preferable.

(Effect of Embodiment 1)

In Embodiment 1, it is possible to prevent the side plate portion, provided with the drum bearing mounting hole 28*a* of the photosensitive drum container 28, from projecting toward the developing sleeve 22. For this reason, when the drum cartridge 270 is inserted and removed, a spacing amount of the developing cartridge 220 can be made small, so that downsizing of the image forming apparatus 100 was realized. Even when the photosensitive drum container 28 of the drum cartridge 270 is provided with the key groove shaped portion 28*b* for permitting passage of the projected shaped portion 45*c* therethrough, the casing is not required to be extended to an outside of the projected shaped portion 45*c*. A part of the photosensitive drum container 28 is prevented from projecting toward the developing sleeve 22, and therefore when the drum cartridge 270 is pulled out, the photosensitive drum container 28 does not interfere with the developing sleeve 22. For this reason, a distance in which the developing sleeve 22 was spaced from the drum cartridge 270 was decreased, so that the image forming apparatus was downsized.

In Embodiment 1, the shape of the side plate portion where the drum bearing mounting bole 28*a* is provided can be made small without providing the drum bearing mounting hole 28*a* of the photosensitive drum container 28 with the opening part (28*b*' in FIG. 10). For this reason, it becomes possible to realize simplification and downsizing of the structure of the image forming apparatus.

In Embodiment 1, the direction in which the photosensitive drum bearing 45R is inserted into the drum bearing mounting hole 28*a* and thereafter is rotated toward the normal position thereof is the same direction as the rotational direction of the photosensitive drum 27. For this reason, during the operation, a degree of positional deviation of the photosensitive drum 27 due to a load exerted on the photosensitive drum bearing 45R when the photosensitive drum 27 is rotated can be reduced. The influence on the photosensitive drum 27 due to the load exerted on the photosensitive drum bearing 45R when the photosensitive drum 27 is rotated can be reduced.

In Embodiment 1, the key groove shaped portion 28*b* is in an overlapping position with the charging roller 24 in the projected plane in the rotational axis direction. For this reason, the key groove shaped portion 28*b* can be disposed using a region of the side plate portion prepared for the charging roller 24, so that there is no need to extend the photosensitive drum container 28 for disposing the key groove shaped portion 28*b*.

In Embodiment 1, the arcuate portion of the projected shaped portion 45*c* is provided so as to contact the developing sleeve bearing 44 which is an example of a developing-side bearing portion for rotatably supporting the developing sleeve 22. For this reason, there is no need to provide a member exclusively for positioning.

<Embodiment 2>

Figure 17:
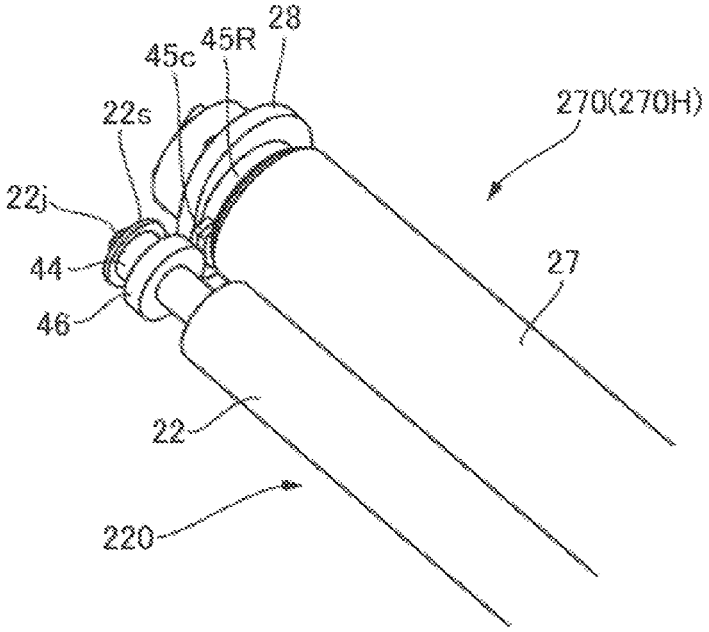
FIG. 17 is an illustration of a developing sleeve positioning mechanism in Embodiment 2.

FIG. 17 is an illustration of a developing sleeve positioning mechanism in Embodiment 2. As shown in FIG. 8, in Embodiment 1, the projected shaped portion 45*c* of the photosensitive drum bearing 45R was abutted against the developing sleeve bearing 44*b*. On the other hand, in this embodiment, separately from the developing sleeve bearing 44*b*, a developing sleeve positioning member 46 for positioning the developing sleeve 22 by being abutted against the projected shaped portion 45*c* of the photosensitive drum bearing 45R was provided. Constitutions other than this in this embodiment are the same as those in Embodiment 1, and therefore in FIG. 17, constituent elements which are the same as those in Embodiment 1 are represented by the reference numerals or symbols common to FIGS. 8 and 17 and will be omitted from redundant description.

As shown in FIG. 17, the developing sleeve positioning member 46 is formed in a ring shape by cutting a fluorine-containing resin material. The developing sleeve positioning member 46 is rotatably held by the rotation shaft 22*j* of the developing sleeve 22 with no backlash.

The rotation shaft 22*j* is provided with the developing sleeve bearing 44*b* outside the developing sleeve positioning member 46 with respect to the rotational axis direction of the developing sleeve 22, and is provided with a positioning ring 22*s* outside the developing sleeve bearing 44*b* with respect to the rotational axis direction.

As described above, a circumferential portion in Embodiment 2 is a ring-shaped positioning member mounted on the rotation shaft of the developing sleeve 22.

<Other Embodiments>

With respect to dimensions, materials, shapes and relative arrangement of the constituent elements described in Embodiments 1 and 2, the scope of the present invention is not intended to be limited thereto unless otherwise particularly specified.

A constitution similar to the constitution of the rear-side photosensitive drum bearing 45R can be employed also for the front-side photosensitive drum bearing 45F. The projected shaped portions 45*c*, 45*d* were contacted to the developing sleeve bearings 44*b*, 44*a*, respectively, but for a purpose other than the contact of the projected shaped portions 45*c*, 45*d* with the developing sleeve bearings 44*b*, 44*a*, the present invention can be carried out also in an embodiment in which the projected shaped portion toward the developing cartridge is formed on the photosensitive drum bearing.

The developing-side arcuate portion and ridge line 45*n* may also have an arcuate surface or an arcuate line as a ridge line.

While the present invention has been described with reference to exemplary embodiment, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-011550 filed on Jan. 23, 2015, which is hereby incorporated by reference herein in its entirety.

What is claimed is:

1. An image forming apparatus comprising:

a main assembly;

a drum cartridge including an image bearing member configured to carry an image and provided detachably mountable to said main assembly with respect to a rotational axis direction of said image bearing member;

a developing cartridge including a developer carrying member which is rotatable while carrying a developer on a surface thereof and which is configured to develop a latent image formed on said image bearing member, wherein said developing cartridge is provided detachably mountable to said main assembly with respect to the rotational axis direction of said image bearing member;

a moving mechanism configured to movably support said developing cartridge so that said developing cartridge is movable between a mounting position where said developing cartridge is mounted and a spaced position spaced further from a surface of said developing cartridge than the mounting position is;

a first bearing member configured to rotatably support a rotation shaft of said image bearing member and including a first contact portion contacting said developing cartridge to regulate an interval between said image bearing member and said developing cartridge;

a second bearing member configured to rotatably support said rotation shaft of said image bearing member and including a second contact portion contacting said developing cartridge to regulate an interval between said image bearing member and said developing cartridge;

a first mounting portion which is provided on a first side surface provided at one end side of said drum cartridge with respect to the rotational axis direction of said image bearing member and on which said first bearing member is mounted, wherein said first mounting portion includes a first hole into which said first bearing member is inserted and which includes a first supporting portion configured to support said first bearing member and a first groove portion through which said first contact portion is passable; and a second mounting portion which is provided on a second side surface provided at the other end side of said drum cartridge with respect to the rotational axis direction of said image bearing member and on which said second bearing member is mounted, wherein said second mounting portion includes a second hole into which said second bearing member is inserted and which includes a second supporting portion configured to support said second bearing member and a second groove portion through which said second contact portion is passable;

wherein the first side surface is provided at a downstream side of said drum cartridge with respect to an inserting direction of said drum cartridge into said main assembly, wherein a phase where said first groove portion is provided is different from a phase where said first contact portion is positioned when said first bearing member is mounted, wherein a phase where said second groove portion is provided is the same as a phase where said second contact portion is positioned when said second bearing member is mounted, and wherein as viewed in the rotational axis direction of said image bearing member, on a line connecting a rotation center of said image bearing member and a rotation center of said developer carrying member, an exterior side of the first side surface facing the developer carrying member is positioned closer to the rotation center of said image bearing member than an exterior side of the second side surface is.

2. The image forming apparatus according to claim 1, wherein said drum cartridge includes a charging member configured to charge said image bearing member, and wherein as viewed in the rotational axis direction of said image bearing member, said first groove portion is provided at a position where at least a part thereof overlaps with a region where said charging member is disposed.

3. The image forming apparatus according to claim 1, wherein as viewed in the rotational axis direction of said image bearing member, on the line connecting the rotation center of said image bearing member and the rotation center of said developer carrying member, an exterior side of the first side surface facing the developer carrying member is disposed closer to the rotation center of said image bearing member than a contact face of said first contact portion of said first bearing member.

4. The image forming apparatus according to claim 1, wherein said developer carrying member is positioned between the first side surface and the second side surface of said drum cartridge with respect to the rotational axis direction of said image bearing member.

5. The image forming apparatus according to claim 1, wherein the first hole is formed so as to surround a full circumference of said first bearing member inserted into the first hole, and the second hole is formed so as to surround a full circumference of said second bearing member inserted into the second hole.

6. An image forming apparatus comprising:

a main assembly;

a drum cartridge including an image bearing member configured to carry an image and provided detachably mountable to said main assembly with respect to a rotational axis direction of said image bearing member;

a developing cartridge including a developer carrying member which is rotatable while carrying a developer on a surface thereof and which is configured to develop a latent image formed on said image bearing member, wherein said developing cartridge is provided detachably mountable to said main assembly with respect to the rotational axis direction of said image bearing member;

a moving mechanism configured to movably support said developing cartridge so that said developing cartridge is movable between a mounting position where said developing cartridge is mounted and a spaced position spaced further from a surface of said developing cartridge than the mounting position is;

a first bearing member configured to rotatably support a rotation shaft of said image bearing member and including a first contact portion contacting said developing cartridge to regulate an interval between said image bearing member and said developing cartridge;

a second bearing member configured to rotatably support said rotation shaft of said image bearing member and including a second contact portion contacting said developing cartridge to regulate an interval between said image bearing member and said developing cartridge;

a first mounting portion which is provided on a first side surface provided at one end side of said drum cartridge with respect to the rotational axis direction of said image bearing member and on which said first bearing member is mounted, wherein said first mounting portion includes a first hole into which said first bearing member is inserted and which includes a first supporting portion configured to support said first bearing member and a first groove portion through which said first contact portion is passable; and a second mounting portion which is provided on a second side surface provided at the other end side of said drum cartridge with respect to the rotational axis direction of said image bearing member and on which said second bearing member is mounted, wherein said second mounting portion includes a second hole into which said second bearing member is inserted and which includes a second supporting portion configured to support said second bearing member and a second groove portion through which said second contact portion is passable;

wherein the first side surface is provided at a downstream side of said drum cartridge with respect to an inserting direction of said drum cartridge into said main assembly, wherein a phase where said first groove portion is provided is different from a phase where said first contact portion is positioned when said first bearing member is mounted, and wherein as viewed in the rotational axis direction of said image bearing member, on the line connecting the rotation center of said image bearing member and the rotation center of said developer carrying member, an exterior side of the first side surface facing the developer carrying member is disposed closer to the rotation center of said image bearing member than a contact face of said first contact portion of said first bearing member.

7. The image forming apparatus according to claim 6, wherein a phase where said second groove portion is provided is the same as a phase where said second contact portion is positioned when said second bearing member is mounted.

8. The image forming apparatus according to claim 6, wherein the first hole is formed so as to surround a full circumference of said first bearing member inserted into the first hole, and the second hole is formed so as to surround a full circumference of said second bearing member inserted into the second hole.

* * * * *